United States Patent [19]

Machida et al.

[11] Patent Number: 4,464,100

[45] Date of Patent: Aug. 7, 1984

[54] SCROLL FLUID APPARATUS HANDLING COMPRESSIBLE FLUID

[75] Inventors: Shigeru Machida, Ibaraki; Kenji Tojo, Shimizu; Masato Ikegawa, Ibaraki; Masao Shiibayashi, Shimizu, all of Japan

[73] Assignee: Hitachi, Ltd., Tokyo, Japan

[21] Appl. No.: 391,978

[22] Filed: Jun. 24, 1982

[30] Foreign Application Priority Data

Jun. 24, 1981 [JP] Japan ..... 56-96644

[51] Int. Cl.[3] ..... F04C 18/02

[52] U.S. Cl. ..... 418/55

[58] Field of Search ..... 418/55, 57, 59

[56] References Cited

U.S. PATENT DOCUMENTS

| | | | |
|---|---|---|---|
| 801,182 | 10/1905 | Creux | 418/55 |
| 3,802,809 | 4/1974 | Vulliez | 418/55 |
| 3,884,599 | 5/1975 | Young et al. | 418/55 |
| 4,082,484 | 4/1978 | McCullough | 418/55 |
| 4,129,405 | 12/1978 | McCullough | 418/55 |
| 4,160,629 | 7/1979 | Hidden et al. | 418/55 |

FOREIGN PATENT DOCUMENTS

| | | | |
|---|---|---|---|
| 50974 | 5/1982 | European Pat. Off. | 418/55 |

*Primary Examiner*—John J. Vrablik

*Attorney, Agent, or Firm*—Antonelli, Terry & Wands

[57] ABSTRACT

A scroll fluid apparatus for handling a compressible fluid and including stationary and orbiting scroll members. The stationary scroll member has a high-pressure central port located in the vicinity of the center thereof and having a profile which is defined by a boundary line located in a region defined by first and second circles both being centered at a point located on a straight line extending through the positions in which the inner ends of wraps are contact with the inner side walls of the opposing wraps, respectively, in the reference condition. The first circle has a diameter equal to the distance between the above-mentioned positions and the second circle has a diameter such that it is in contact with the inner side walls of the wraps.

6 Claims, 10 Drawing Figures

SCROLL FLUID APPARATUS HANDLING COMPRESSIBLE FLUID

BACKGROUND OF THE INVENTION

1. Field of the Invention

This invention relates to a scroll fluid apparatus handling a compressible fluid that can be utilized as compressors including compressors of air conditioning systems, refrigerating apparatus, freezing apparatus, etc. and compressors for raising the air pressure, vacuum pumps and expanders for generating a rotary motive force.

2. Description of the Prior Art

A substantial number of patents have been issued on scroll fluid apparatus including, for example, U.S. Pat. Nos. 801,182 to Creux, 3,802,809 to Vulliez, 3,884,599 to Young et al, 4,082,484 and 4,129,405 to McCullough, and 4,160,629 to Hidden et al.

Of all these patents, only Hidden et al. and McCullough ('405) are directed to an inlet port and an outlet port for a fluid handled by the scroll fluid apparatus.

Hidden et al. and McCullough both relate to a liquid pump and comprise inlet and outlet ports and liquid transfer passage means maintained in communication with these ports, so as to discharge a stream of fluid free from pulsations quietly, at a considerably high speed and with a high degree of efficiency.

Young et al. ('599) shows a high pressure port of circular shape, which is located in such a manner that a part of the circle defining the port is substantially coincides with a part of the outer side wall curve of the wrap of the orbiting scroll member at the moment just before the moment when the sealed compression pockets are in communication with the center pocket. It should be noted, however, that Young et al. does not disclose the actual profile of the port. In addition, if the high pressure port illustrated in the drawings of Young et al. is assumed to be the actual profile, the port is not satisfactory because sufficient seal would not be maintained between the port and the sealed compression pocket defined by the outer side wall of the orbiting wrap and the inner side wall of the stationary wrap. More specifically, since the relative movement between the end face of the orbiting wrap and the opposing surface of the stationary end plate is small, and the distance between the port and the sealed pocket is very small at the end of compression stroke, effective sealing of the gap between the end face of the wrap and the opposing surface of the end plate would not be expected so that a large amount of gas leakage from the port into the sealed compression pocket through the gap would occur.

SUMMARY OF THE INVENTION

Accordingly, an object of this invention is to provide a scroll fluid apparatus having a central port of a profile and/or a position which offers minimal flow resistance to the flow of a compressible fluid introduced into and released from the apparatus through the central port and which is capable of maintaining good seal between the central port and an adjacent sealed fluid pocket defined by two scroll members and being in compression stroke or expansion stroke.

Another object of the present invention is to provide a scroll fluid apparatus having a central port of a profile and/or a position enabling compression function or expansion function performed by fluid pockets formed by two scroll members to be maintained in optimum condition.

A further object of the present invention is to provide a scroll fluid apparatus having a central port of a profile and/or a position capable of reducing, or preferably minimizing, the velocity at which a compressible fluid released from the fluid pockets flows through the central port.

The aforesaid objects of the invention can be accomplished by imparting to a central port, a profile in a plane parallel to an end plate of a scroll member in such a manner that a portion of the profile is located between inner and outer side wall curves of a stationary wrap and an other portion of the profile is located between inner and outer side wall curves of an orbiting wrap in a reference condition in which inner ends of the stationary and orbiting wraps are brought into closest proximity to or contact with the associated inner side surfaces of the wraps, respectively, so that a fluid pocket communicating with the central port is minimum in volume. The profile of the central port in a plane parallel to the end plate is preferably resembled closely to the cross-sectional shape of the fluid pocket of the minimum volume, so that an area specified by the profile of the central port is substantially the same as the cross-sectional area of the minimum volume fluid pocket.

Thus, in the case of a compressor in which the central port functions as an outlet port, there is almost no hindrance to the flow of the compressible fluid when it is discharged from the fluid pockets into the central port, thereby reducing resistance to the flow of the fluid. If the cross-sectional area of the central port is greater than the cross-sectional area of the minimum volume fluid pocket, then optimum results can be achieved with regard to discharge resistance and the flow velocity of the compressible fluid.

Also, while the fluid pockets formed by the portions of the two end plates and two spiral wraps in closest proximity to or contact with each other are substantially closed, the closed fluid pockets are prevented from communicating with the central port, so that the compression or expansion taking place when the fluid pockets are closed is not interfered with to allow the apparatus to function normally.

In the specification of this invention, the term "reference condition" refers to a condition to which the orbiting scroll member is brought for an instant during its orbiting movement and in which an inner starting point of an outer side wall curve of the spiral wrap of one of the two scroll members is brought into closest proximity to or contact with an inner side wall curve of a spiral wrap of the other scroll member so that the volume of the fluid pocket in the vicinity of the center can be minimized by the two scroll members.

DETAILED DESCRIPTION OF THE PREFERRED EMBODIMENTS

Figure 3:
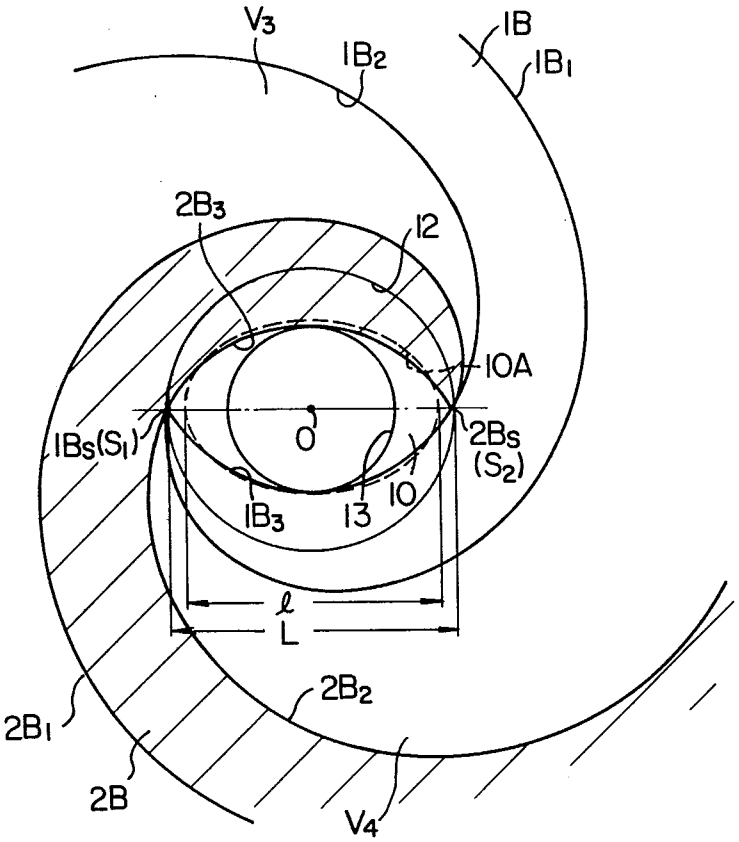
FIG. 3 is a view, on an enlarged scale, of the central portion of the scroll member shown in FIG. 1.
Figure 1:
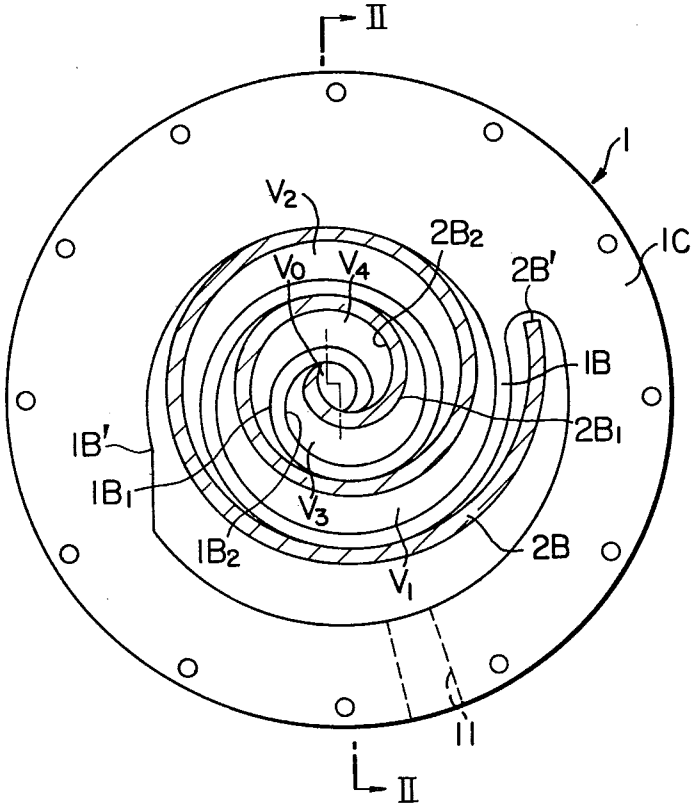
FIG. 1 is a sectional view taken at a right angle to the axis of the scroll fluid apparatus comprising one embodiment of the invention corresponding to a sectional view taken along the line I—I in FIG. 2.
Figure 2:
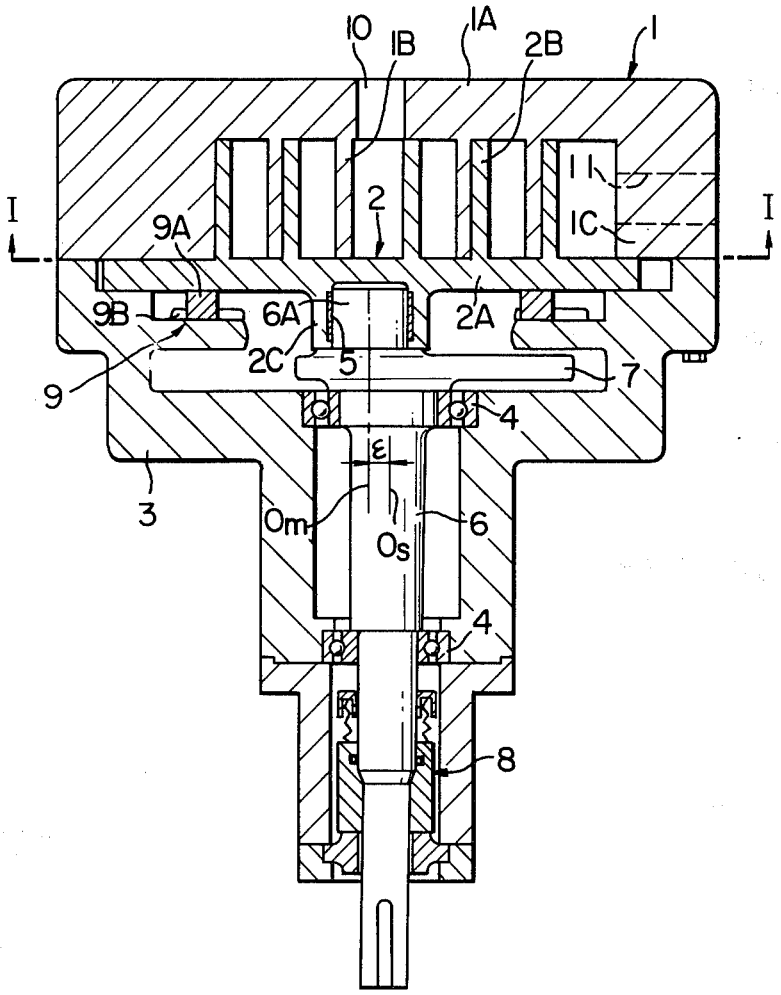
FIG. 2 is a vertical sectional view taken along the line II—II in FIG. 1.

Referring now to the drawings when like reference numerals are used throughout the various views to designate like parts and, more particularly, to FIGS. 1–3, according to these figures, a fixed scroll member generally designated by the reference numeral 1 comprises an end plate portion 1A which is circular in profile on the outer side, a spiral wrap 1B defined by a curve in which an involute curve and an arc are connected together, the spiral wrap 1B being located on the end plate portion 1A in upstanding position, and an annular portion 1C located in upstanding position around the spiral wrap 1B on the end plate portion 1A and extending to the same height as the spiral wrap 1B.

An orbiting scroll member generally designated by the reference numeral 2 comprises a circular end plate portion 2A, a spiral wrap 2B located in upstanding position on the end plate portion 2A having essentially the same shape and configuration as the spiral wrap 1B, and a scroll boss 2C located at the back of the end plate portion 2A.

The two spiral wraps 1B and 2B have their profiles defined by outer side wall curves $1B_1$ and $2B_1$ setting an outer boundary and inner side wall curves $1B_2$ and $2B_2$ setting an inner boundary, respectively. The outer side wall curves $1B_1$ and $2B_1$ are composed of involute curves extending from starting points $1B_s$ and $2B_s$, respectively. The inner side wall curves $1B_2$ and $2B_2$ are composed of arcs $1B_3$ and $2B_3$ adjacent to the starting points $1B_s$ and $2B_s$ and involute curves connected to the arcs, respectively.

Instead of involute curves, spirals each including a plurality of arcs connected together, may be used as curves for setting the boundaries of the wraps 1B and 2B.

The two scroll members 1 and 2 are arranged such that the two spiral wraps 1B and 2B face each other in meshing engagement and outer or terminating ends 1B' and 2B' of the spiral wraps 1B and 2B respectively are displaced from each other by about 180 degrees.

A frame 3 is connected through a plurality of bolts, not shown, to the annular portion 1C of the fixed scroll member 1.

A drive shaft 6 is rotatably supported by two rolling bearings 4 on the frame 3. The rolling bearings 4 may be replaced by one or two plain bearings.

The drive shaft 6 has at its head an eccentric shaft 6A having a center axis Om in a position spaced apart from the center axis Os of the drive shaft 6 by a distance $\epsilon$. A balance weight 7 is attached to the drive shaft 6. The eccentric shaft 6A is fitted through a bearing 5 (which may be a needle bearing, plain bearing, etc.) into the scroll boss 2C of the orbiting scroll member 2.

Arranged in a position in which the drive shaft 6 extends outwardly of the frame 3 after penetrating therethrough is a mechanical seal 8 of the type disclosed, for example, in U.S. Pat. Nos. 3,884,599 and 3,994,536'.

A rotation-on-its-own-axis preventing mechanism 9 is associated to the orbiting scroll member 2. The mechanism 9 includes a ring 9A a first pair of keys 9B and a second pair of keys (not shown). The first pair of keys 9B are secured to the frame 3 and the second pair of keys, are secured to the back of the end plate 2A of the orbiting scroll member 2 in such a manner that they extend in a direction at right angles to the keys 9B. The ring 9A is formed at one end surface thereof with grooves, not shown, in which the keys 9B are slidably fitted and at the other end surface thereof with grooves, not shown, in which the second pair of keys are slidably fitted, with the two pairs of grooves extending in directions at right angles to each other like the first and second pair of keys.

The fixed scroll member 1 is formed with port means comprising a central port 10 disposed in the vicinity of the central portion of the member 1 to function as a high-pressure port, and a port 11 which is a low-pressure port formed through an outer wall of the end plate portion 1A. In the event that the fixed scroll member 1 is of a type having no annular portion 1C, the low-pressure port 11 may be dispensed with.

The profile of the central port 10 in a plane at a right angle to the axis will be described in detail. The profile of the central port 10 is set on the basis of the "reference condition" of the scroll fluid apparatus. The reference condition is described by referring to FIGS. *7a–7d,* which illustrate the manner in which the scroll apparatus performs compression of gas. In FIG. *7a,* two sealed pockets $V_3$ and $V_4$ and a central pocket $V_o$ connected to a central port 10 are defined by the two wraps 1B and 2B. Due to the orbiting movement of the orbiting wrap 2B, the pockets are gradually reduced in volume as shown in FIGS. *7b, 7c* and *7d,* so that fluid in the sealed pocket $V_3$ and $V_4$ is compressed while fluid in the center pocket $V_o$ is discharged through the central port. FIG. *7d* shows the state in which the volumes of the sealed pockets $V_3$ and $V_4$ and the central pocket $V_o$ are minimum and the inner ends $1B_s$ and $2B_s$ of the wraps are brought into closest proximity to or contact with the associated inner side surfaces of the wraps. Further orbiting movement of the wrap 2B from the state of FIG. *7d* moves the inner ends $1B_s$ and $2B_s$ of the wraps away from the inner side surfaces of the wraps so that the pockets $V_3$ and $V_4$ are brought into communication with the central pocket $V_o$. Then the apparatus returns to the state of FIG. *7a.* The state shown in FIG. *7d* is referred to as the reference condition.

Referring to FIG. 3 which shows the scroll fluid apparatus in the reference condition, the profile of the central port 10 in a plane at a right angle to the axis has a boundary line 10A shown in a broken line which is elliptic in form and interposed between two circles 12 and 13. The circle 12 is centered at a point O located on a straight line extending through points $S_1$ and $S_2$ and equidistantly spaced apart therefrom. The points $S_1$ and $S_2$ are the points at which the starting point $1B_s$ of the outer side wall curve $1B_1$ of the wrap 1B and the starting point $2B_s$ of the outer side wall curve $2B_1$ of the wrap 2B are positioned in the reference condition. The circle 12 has a diameter which is equal to the distance between the points $S_1$ and $S_2$. The circle 13 is one which is centered at the point O and in contact with the inner side wall curves $1B_3$ and $2B_3$ of the two spiral wraps 1B and 2B, respectively. The boundary line 10A of the elliptic central port 10 is located inwardly of the points $S_1$ and $S_2$ and has a cross-sectional area which is substantially equal to the cross-sectional area of the minimum volume fluid pocket Vo in the reference condition. The distance l between the points at which the boundary line 10A intersects the line connecting together the points $S_1$ and $S_2$ is selected to be nearly equal L where L is the distance between the points $S_1$ and $S_2$.

Operation of the first embodiment constructed as aforesaid will be described. Upon the drive shaft 6 being driven by a prime mover, not shown, to rotate clockwise in FIG. 1, rotation of the drive shaft 6 is transmitted through the eccentric shaft 6A, bearing 5 and scroll boss 2C to the orbiting scroll member 2 as an orbiting movement passing through the center axis Os, to let the orbiting scroll member 2 move in orbiting movement without varying its posture about the center axis Os because the orbiting scroll member 2 has its angular relation fixed by the rotation-on-its-own axis preventing mechanism 9. Thus, the orbiting wrap 2B orbits relative to the stationary wrap 1B, as shown in FIGS. *7a* to *7d*, so that a compressible fluid is drawn by suction through the low pressure port 11 into fluid pockets and compressed therein. Immediately after the apparatus has reached the reference condition shown in FIG. 3 and FIG. *7d*, the fluid pockets $V_3$ and $V_4$ adjacent to the central fluid pocket $V_o$ are brought into communication with the central pocket $V_o$ and then directly with the central port 10 so that the compressed fluid in the pockets $V_3$ and $V_4$ are discharged to the central port 10 through the central pocket $V_o$.

The aforesaid operation is performed when the fluid scroll apparatus functions as a compressor. By causing a compressible fluid of high temperature and pressure to flow through the central port 10 into the fluid pockets $V_3$ and $V_4$, the volumes of the fluid pockets $V_3$ and $V_4$ gradually increase because of the force of expansion of the compressible fluid in the fluid pockets $V_3$ and $V_4$, so that motive force is produced at this time. The fluid scroll apparatus of the aforesaid construction can be used as an expander to develop motive force.

By imparting an elliptic profile to the central port 10, the fluid pockets $V_3$ and $V_4$ can be brought into communication with the central port 10 as soon as the apparatus is displaced by the orbiting movement of the orbiting scroll member 2 from the reference condition, to thereby enable the compressible fluid in the fluid pockets $V_3$ and $V_4$ to be smoothly released therefrom with the least resistance being offered to the flow of the fluid as the pockets $V_3$ and $V_4$ continuously diminish in volume. The central port 10 has a sufficiently large cross-sectional area. This arrangement makes it possible to reduce the flow velocity of the compressible fluid flowing through the central port 10, to thereby keep a loss by the flow at a low level.

Moreover, in this embodiment, a portion of the boundary line 10A setting the profile of the central port 10 is located below a land defined between the inner and outer side walls of the orbiting wrap 2B, in the reference condition so that a satisfactory seal can be provided between the central port 10 and the fluid pocket $V_3$ while giving a cross-sectional area of a enough value to the port 10.

Figure 4:
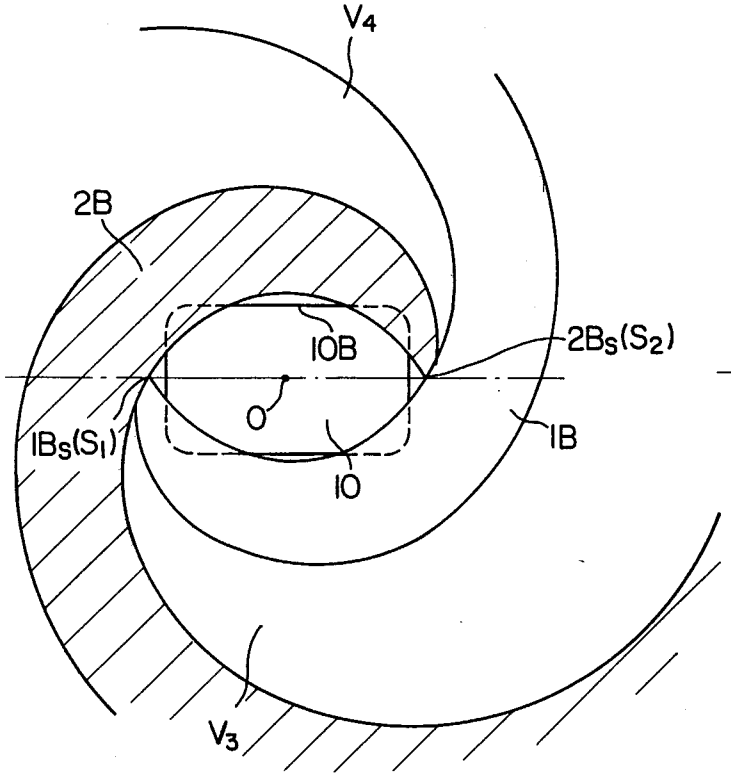
FIG. 4 is a view, on an enlarged scale, of the essential portions of the second embodiment.

In the second embodiment of FIG. 4 a curve 10B for setting the boundary of the profile of the central port 10 is quadrilateral with its four corners being in the form of arcs. The boundary line 10B for setting the profile as shown in FIG. 4 is of minimum size.

Figure 5:
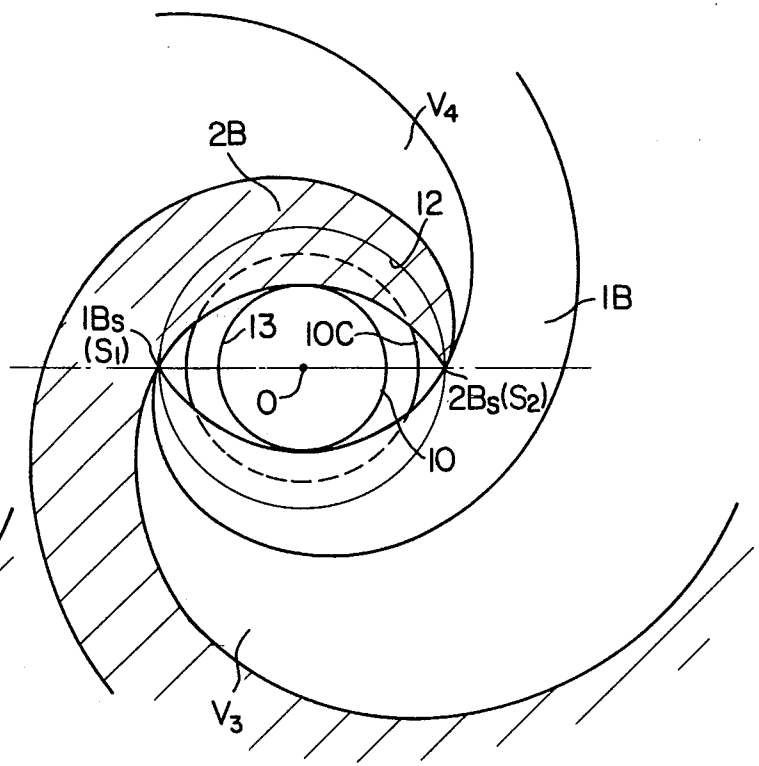
FIG. 5 is a view, on an enlarged scale, of the essential portions of the third embodiment.

In the third embodiment of FIG. 5, a curve 10C for setting the boundary of the profile of the central port 10 is a circle centered at the point O described hereinabove. In FIG. 5, the curve 10C may agree with the circle 12, circle 13 or a circle centered at a point besides the point O capable of placing the profile-setting curve 10C in a region surrounded by the circles 12 and 13.

Figure 6:
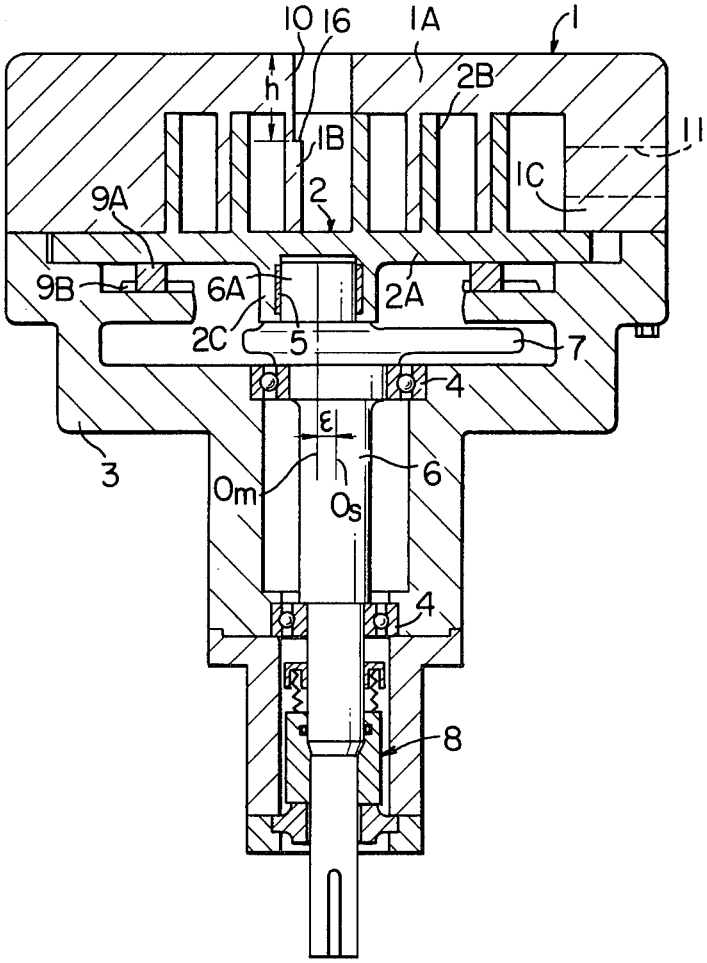
FIG. 6 is a vertical sectional view of the scroll fluid apparatus comprising the fourth embodiment; and FIGS. *7a–7d* are diagrams showing compression function of the scroll apparatus.
Figure 7A:
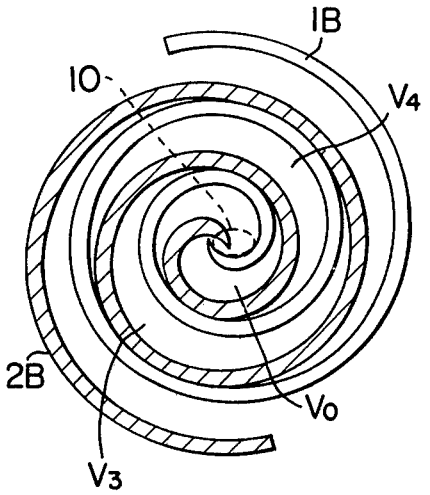
Figure 7B:
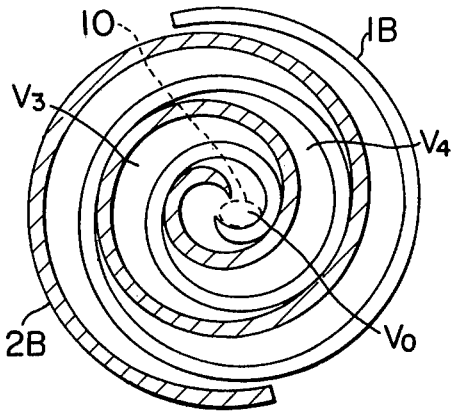
Figure 7C:
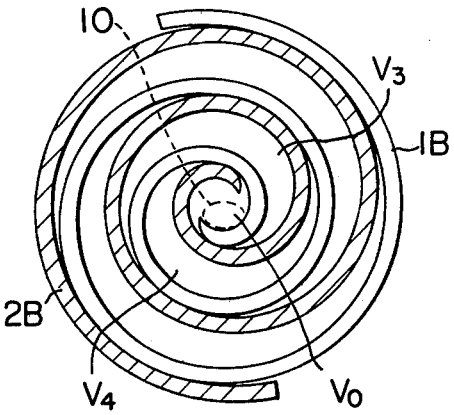
Figure 7D:
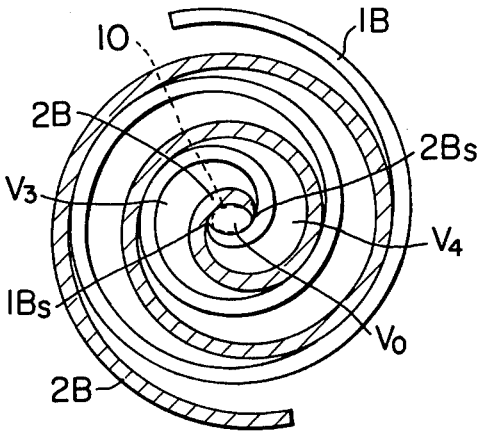

In the embodiment of FIG. 6, the axial depth h of the central port 10 which, as measured from the surface of the end plate 1A, is greater than the thickness of the end plate 1A. As a result, the central port extends to a portion 16 of the spiral wrap 1B. Description of combinations of various other embodiments with the embodiment of FIG. 6 shall be omitted. However, it is to be understood that the embodiment of FIG. 6 is carried into practice according to the invention by forming a combination with the profile of the central port 10 in a plane at a right angle to the axis described in each of the first to the third embodiments inclusive.

In the embodiment of FIG. 6, the portion 16 of the spiral wrap 1B at which the lower end of the central port 10 is located may be inclined as desired.

In addition to the various advantages offered by the embodiments of FIGS. 1–5, inclusive, the embodiment of FIG. 6 offers the advantage that the axial flow of the compressible fluid released from the fluid pocket into the central port 10 can be made to take place with increased smoothness and the resistance offered to such flow to be reduced. Also, when the fixed scroll member 1 is machined to form the central port 10, it is possible to readily set the depth to which machining is performed.

In the foregoing description, the various embodiments of the invention have been described as being applied to compressors. However, it is to be understood that as described by referring to the first embodiment, all the embodiments can be utilized as expanders.

What is claimed is:

1. A scroll fluid apparatus handling a compressible fluid, the apparatus comprising an orbiting and a stationary scroll member, one of said scroll members including an end plate, and a spiral wrap located in an upstanding position on said end plate and having an inner side wall curve including a starting end portion in the form of an arc, and the other scroll member including an end plate, a spiral wrap of substantially the same shape and configuration as that of said one scroll member, and at least one port for the compressible fluid to flow therethrough, said two scroll members are arranged in such a manner that said spiral wraps are meshed with each other and one of said scroll members moves in orbiting movement relative to said the other scroll member while being kept from rotating on its own axis, whereby a plurality of fluid pockets of different pressures defined by said two scroll members can have their volumes varied to thereby compress or expand the compressible fluid, said at least one port is a central port formed in a vicinity of a center of the stationary scroll member and has a profile disposed in a plane parallel to the end plate of the stationary scroll member, said profile being set on the basis of a reference condition in which as said orbiting scroll member moves in an orbiting movement, inner starting points of ourter side wall curves of said spiral wraps of said two scroll members are brought into close proximity to or into contact with inner side wall curves of the spiral wraps of the opposite scroll members and the fluid pocket nearest the center has a volume thereof minimized for an instant, said profile of said central port is measured at a point at which said central port communicates with said fluid pocket nearest the center and is defined by a boundary line located in a region defined by two circles, a first circle of said two circles being centered at a point located on a straight line extending through positions in which the inner starting points of the spiral wraps are positioned in the reference condition and equidistantly spaced apart from said positions, said first circle having a diameter equal to a distance between said positions, a second circle of said two circles centered at the same point as said first circle and having a diameter such that the second circle is in contact with the innermost portions of the inner side wall curves of said spiral wraps in said reference condition, and said profile of said central port is substantially symmetrical about said straight line connecting the inner starting points of the spiral wraps in the reference condition.

2. A scroll fluid apparatus as claimed in claim 1, wherein said central port has a cross-sectional area substantially equal to the cross-sectional area of the minimum volume fluid pocket as measured in a plane parallel to the end plates.

3. A scroll fluid apparatus as claimed in claim 1, wherein said central port is circular in profile.

4. A scroll fluid apparatus as claimed in claim 1, wherein said central port is elliptic in profile.

5. A scroll fluid apparatus as claimed in claim 2, wherein said central port is quadrilateral having arcuate corners in profile.

6. A scroll fluid apparatus as claimed in any one of claims 2–5, wherein said central port has a depth such that as measured from the surface of end plate opposite the surface thereof at which said spiral wrap is located, the depth of said central port is greater than the thickness of the end plate so that the central port extends as far as a portion of the spiral wrap.

* * * * *